US006315172B1

(12) United States Patent
Till

(10) Patent No.: US 6,315,172 B1
(45) Date of Patent: Nov. 13, 2001

(54) TAPPING HEAD FOR TAPPING BEVERAGES PRESSURIZED WITH GAS

(75) Inventor: Rudolf Till, Baden-Baden (DE)

(73) Assignee: IPE Engineering GmbH, Bühl (DE)

( * ) Notice: Subject to any disclaimer, the term of this patent is extended or adjusted under 35 U.S.C. 154(b) by 0 days.

(21) Appl. No.: 09/693,086

(22) Filed: Oct. 20, 2000

(30) Foreign Application Priority Data

Nov. 9, 1999 (DE) ..... 299 19 626 U

(51) Int. Cl.[7] ..... B65D 83/00
(52) U.S. Cl. ..... 222/400.7; 222/509
(58) Field of Search ..... 222/399, 400.7, 222/400.8, 509

(56) References Cited

U.S. PATENT DOCUMENTS

| | | | | |
|---|---|---|---|---|
| 3,272,404 | * | 9/1966 | Graves et al. | 222/396 |
| 3,596,809 | * | 8/1971 | Taubenheim | 222/399 |
| 3,734,352 | | 5/1973 | Dooley . | |
| 4,002,273 | * | 1/1977 | Golding et al. | 222/400.7 |
| 4,180,189 | * | 12/1979 | Zurit et al. | 222/400.7 |
| 4,212,414 | | 7/1980 | Beyens . | |
| 4,228,927 | * | 10/1980 | Beyens et al. | 222/148 |
| 4,450,853 | * | 5/1984 | Dessenoix et al. | 137/212 |
| 5,343,907 | | 9/1994 | Wagner . | |
| 5,511,692 | * | 4/1996 | Willingham | 222/1 |
| 5,535,923 | | 7/1996 | Fujioka . | |
| 5,617,977 | * | 4/1997 | Augustinus | 222/400.7 |
| 5,636,657 | * | 6/1997 | Degenkolbe et al. | 137/212 |
| 5,657,911 | * | 8/1997 | Mogler et al. | 222/400.7 |
| 5,690,136 | * | 11/1997 | Celli | 137/212 |

FOREIGN PATENT DOCUMENTS

| | | | | |
|---|---|---|---|---|
| 28 31 463 | | 2/1979 | (DE) . | |
| 91 09 177.2 | | 12/1991 | (DE) . | |
| 34 38 415 | | 5/1994 | (DE) . | |
| 0432650-A1 | * | 6/1991 | (DE) | B67D/1/08 |
| 0 759 409 | | 8/1996 | (EP) . | |
| 2 659 074 | | 2/1991 | (FR) . | |
| 0294095-A1 | * | 12/1988 | (GB) | B67D/1/08 |
| WO95/11191 | | 4/1995 | (WO) . | |

* cited by examiner

*Primary Examiner*—Kevin Shaver
*Assistant Examiner*—Frederick C Nicolas
(74) *Attorney, Agent, or Firm*—Collard & Roe, P.C.

(57) ABSTRACT

The invention relates to a tapping head for tapping beverage pressurized by gas, comprising a closing bolt (2) accommodated in a housing (1) and surrounded by a slide (4) movable up and down by means of an actuating lever (5); and a $CO_2$-connection (14) for the conveying gas. The tapping head is characterized in that a closing bolt (2) is arranged in the housing (1). The closing bolt is surrounded by a slide (4) that is movable up and down and, in the pouring condition, rests at the barrel-side end in a sealing manner against a flange seal (21) arranged in the lower part of the housing (1), and, in the closing condition, the tappet (19) rests in a sealing manner against the closing bolt (2) by means of an O-ring (19*a*).

6 Claims, 8 Drawing Sheets

TAPPING HEAD FOR TAPPING BEVERAGES PRESSURIZED WITH GAS

BACKGROUND OF THE INVENTION

1. Field of the Invention

The invention relates to a tapping head for tapping beverages pressurized with gas. Such a tapping head can be mounted on a container, for example a barrel.

2. The Prior Art

All of the tapping heads known until the present time have the problem that the space of the head has to be vented when the beverage container is empty. When the tapping head is set to the down (or closing) position, the head space is not automatically vented, and considerable force is needed to vent the head space of the tapping head. If the pressure of the gas is high, the tapping head cannot be removed from the beverage container connection and no full beverage container can be connected to the tapping head.

In WO 95/11191, venting of the tapping head space is accomplished via a venting bore that is switched by means of a slide, with the tapping head being set in the down (or closing) position.

In another design, the top space of the tapping head is vented by lifting the seal of the tapping head from the slide. Several seals are required with this design as well. It is not possible to exclude that the beverage to be conveyed may be drawn out.

The present invention addresses the problem of providing a tapping head that omits the head (or top) space, and, therefore, no venting of the head or top space is required.

SUMMARY OF THE INVENTION

The present invention solves this problem by providing a tapping head comprising:

(a) a housing;

(b) a flange seal arranged in a lower part of the housing:

(c) a closing bolt arranged in the housing;

(d) a slide surrounding the closing bolt and movable up and down;

(e) a tappet on the slide;

(f) an O-ring provided on the tappet; and (g) a $CO_2$ connection for conveying gas;

wherein in the pouring condition of the tapping head the slide rests against the flange seal and in the closing condition the tappet rests in a sealing manner against the closing bolt by means of the O-ring.

This tapping head offers a number of advantages. For example, no product is drawn into the housing. Furthermore, the tapping head as defined by the invention has at least two seals less than the tapping heads known before. In addition, no special venting of the head space is needed because the tapping head as defined by the invention is self-venting.

Additional inventive features of the tapping head are described below.

BRIEF DESCRIPTION OF THE DRAWINGS

The tapping head as defined by the invention is described in greater detail in the following with the help of the drawings showing preferred embodiments of the tapping head, in which.

DETAILED DESCRIPTION OF PREFERRED EMBODIMENTS

Figure 1:
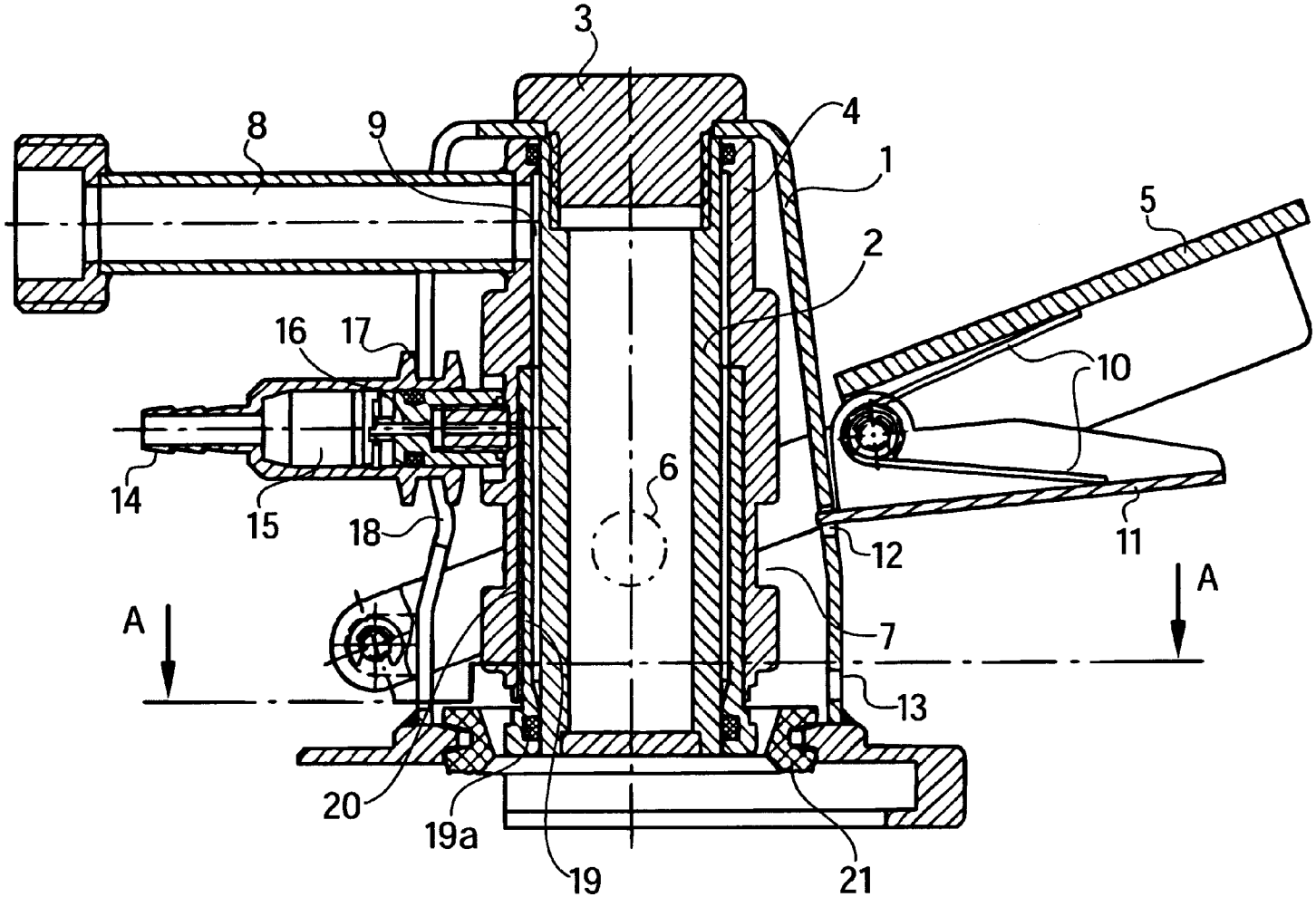
FIG. 1 shows a section through a tapping head as defined by the invention, with the tapping head in the closing (or "down") position.
Figure 2:
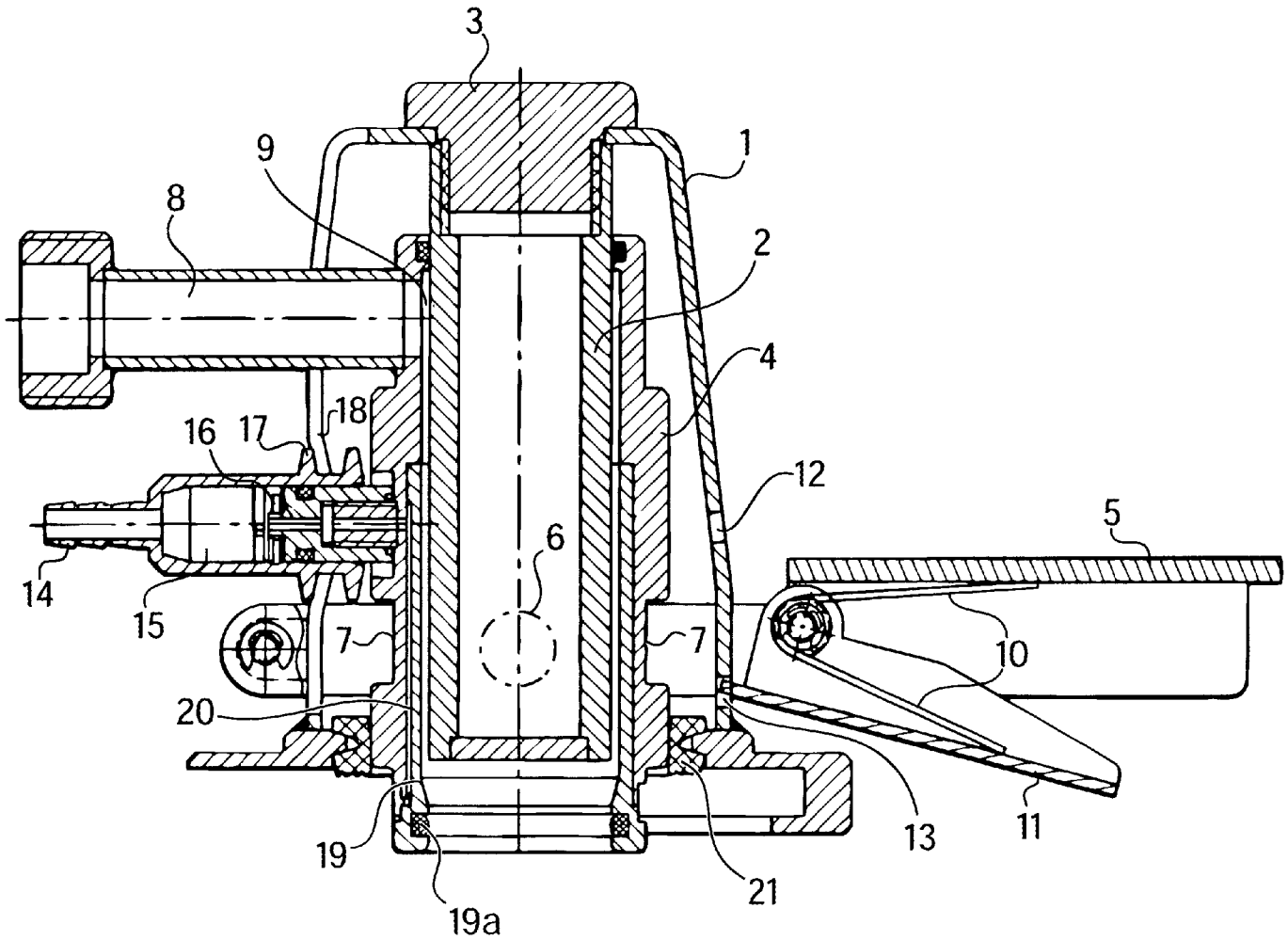
FIG. 2 shows the tapping head of FIG. 1 in the pouring (or "up") position.
Figure 3:
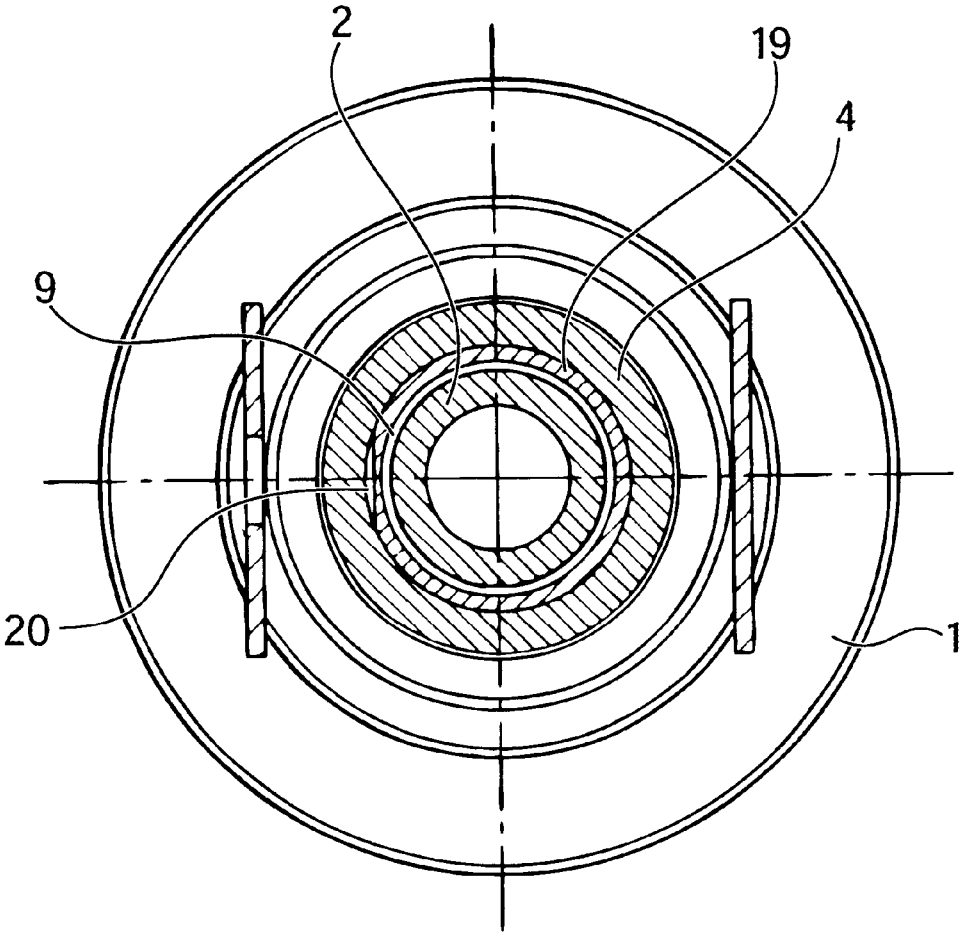
FIG. 3 shows a section along line A—A in FIG. 1.

As shown in FIGS. 1 to 5, the tapping head consists of a housing 1, in which a closing bolt 2 is arranged. The closing bolt is connected with housing 1 by means of a fastening screw 3. Closing bolt 2 is surrounded by a slide 4 that can be moved up and down by means of a lever 5. In this way, lever 5 can move slide 4 into the closing (FIG. 1) or the pouring position (FIG. 2). For this purpose, actuating lever 5 has a driver 6 that engages a groove 7 on slide 4, the groove extending all around.

Furthermore, slide 4 has a connection 8 for connecting the beverage to be conveyed. This connection feeds into a beverage channel 9 located between closing bolt 2 and slide 4. Actuating lever 5 is connected with a locking lever 11 via a bent spring 10. In its upper position, locking lever 11 engages a locking bore 12, and in its lower position engages a locking bore 13. In this way, the slide is fixed in the two end positions. Furthermore, a $CO_2$-hose is arranged on slide 4, and a check valve 15 with a connecting and actuating bolt 16 is arranged in the expanded rear part of the hose connection 14. The $CO_2$-switch 17 has a cut or a groove that engages a switching or switch guide 18 in the housing. A conveying channel 20 for the $CO_2$-gas is provided in the connection to the check valve 15, the channel being located between slide 4 and a tappet 19. Tappet 19 can be driven downwards with slide 4.

A flange seal 21 on the lower part of housing 1 seals the beverage container from slide 4 when the tapping head is in its pouring position.

FIG. 1 shows that when the tapping head is in its closing position, locking lever 11 engages locking bore 12, which retains slide 4 in its upper position. $CO_2$-switch 17 is maintained in this position by the switching or switch guide 18, so that no conveying gas can exit by way of conveying channel 20. This position shows that the tapping head as defined by the invention has no head space at all that would have to be vented. In this position, beverage channel 9 and beverage line connection 8 are closed at the same time via closing bolt 2. Furthermore, the O-ring seal 19*a* provided on the lower end of tappet 19 seals tappet 19 against closing bolt 2.

FIG. 2 shows that when beverage is tapped, the tapping head as defined by the invention is pushed onto the container connection. Subsequently, slide 4 is connected with tappet 19, the tappet 19 being present on the slide, by means of actuating lever 5 via driver 6, and driven into the tapping position via groove 7. Slide 4 is then locked in locking bore 13 via locking lever 11. With slide 4 in this position, $CO_2$-switch 17 is pushed toward actuating bolt 16 and check valve 15 is opened. Conveying gas ($CO_2$) can then flow into the barrel via $CO_2$-hose connection 14 and conveying channel 20. When the spigot is opened, the excess pressure then permits beverage to flow past closing bolt 2 through beverage channel 9 and via beverage line connection 8 to the spigot, and from the spigot into the glass. The admission of gas into the beverage container is sealed off by the slide, compressed via flange seal 21. Now, when the tapping head is moved down, slide 4 with the tappet 19 is lifted from seal 21 and the pressure that built up for conveying the beverage is immediately relieved.

Figure 4:
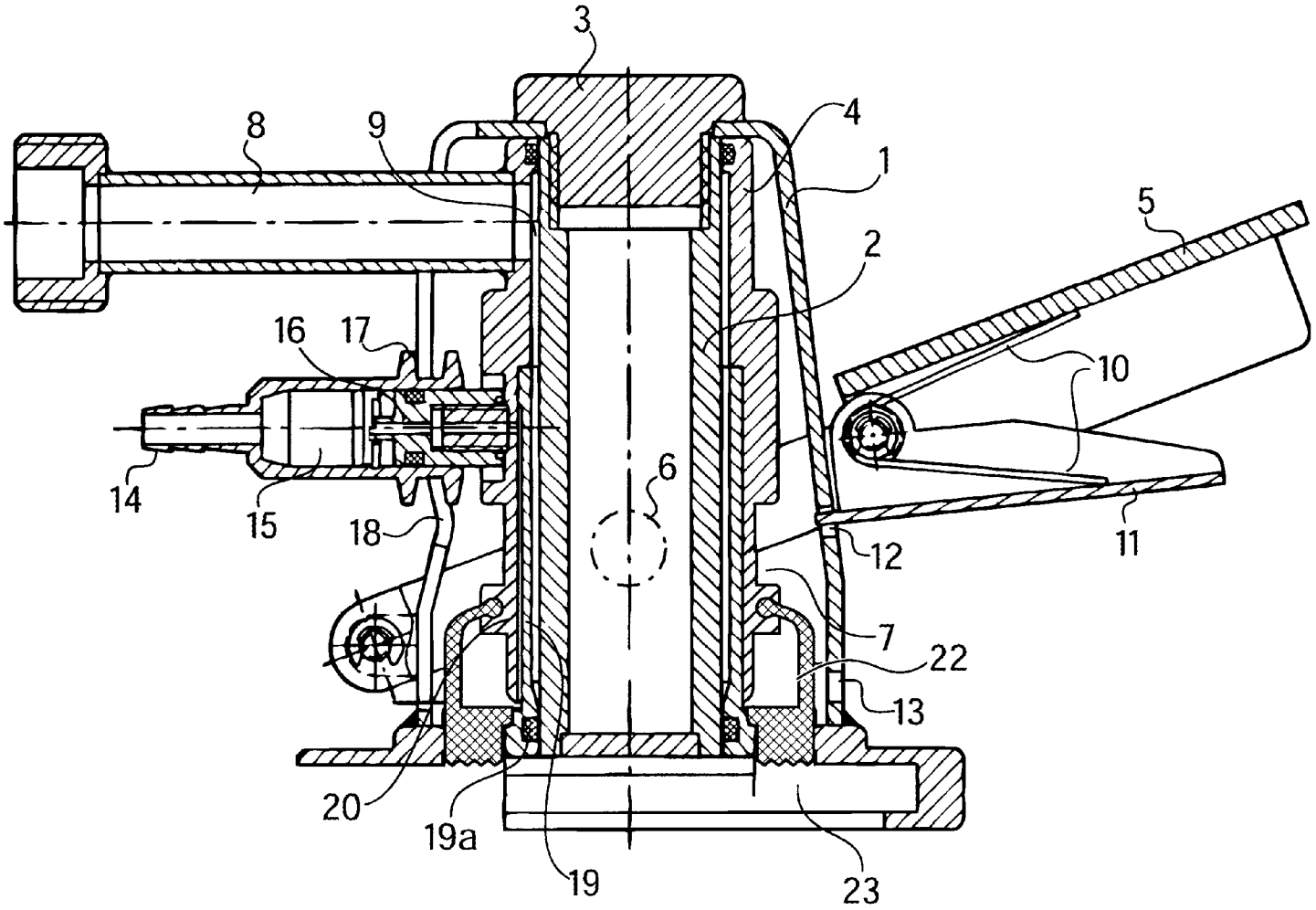
FIG. 4 shows a modified embodiment of the tapping head according to FIG. 1.
Figure 5:
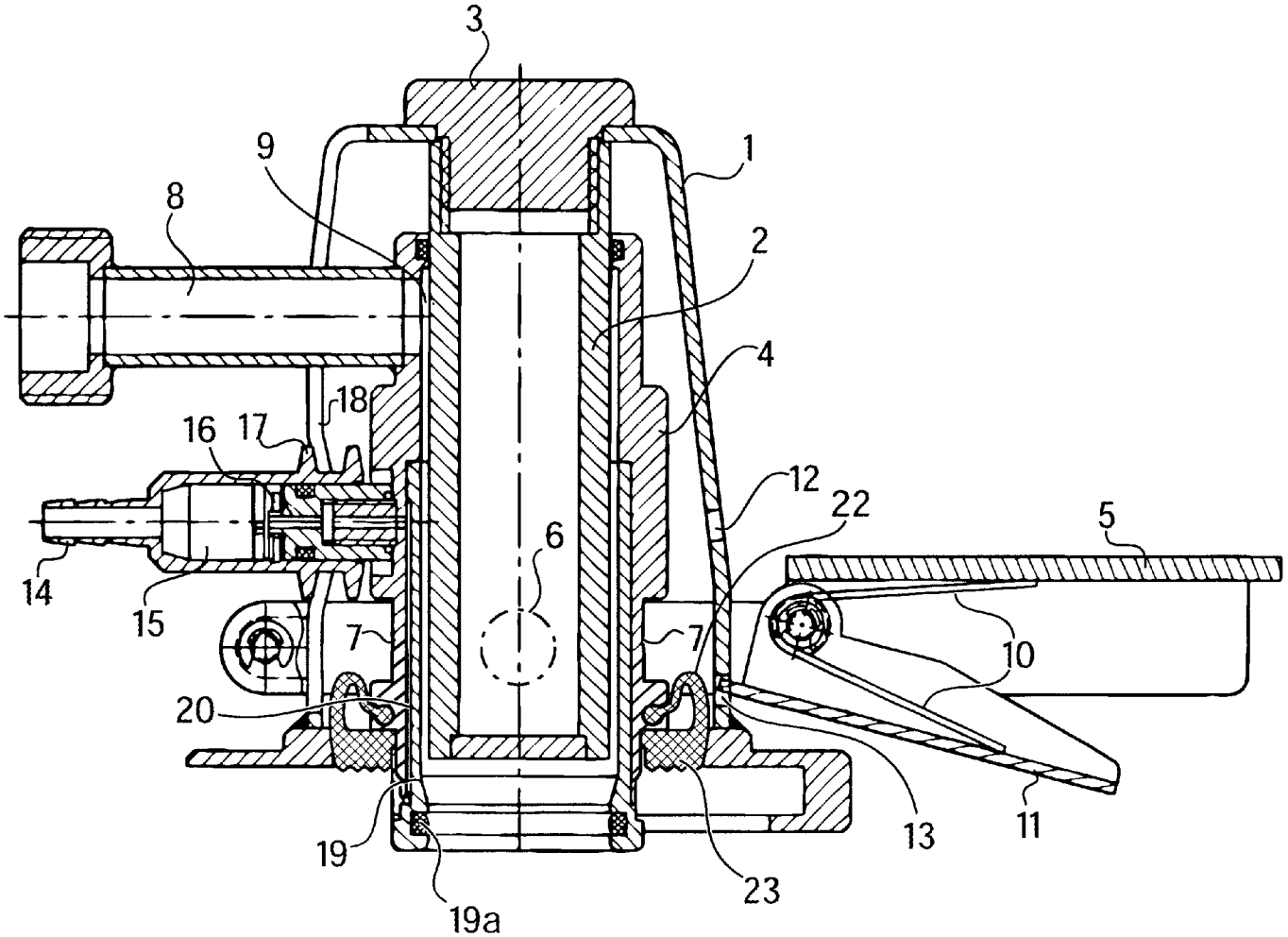
FIG. 5 shows a view similar to FIG. 4 with the tapping head in the pouring (or "up") position.

FIGS. 4 and 5 show another embodiment of the tapping head according to FIGS. 1 and 2. In this embodiment, a flexible sleeve 22 is provided instead of the flange seal 21, the flexible sleeve having a sealing bead 23 located on its lower end. In the closing condition (FIG. 4), sleeve 22 with bead 23 is located in the position shown in FIG. 4.

FIG. 5 shows that when the tapping head is moved down, slide 4 with tappet 19 is driven down into the barrel. Flange 22 is compressed and bead 23 is placed between the barrel and slide 4 in a sealing manner.

Figure 6:
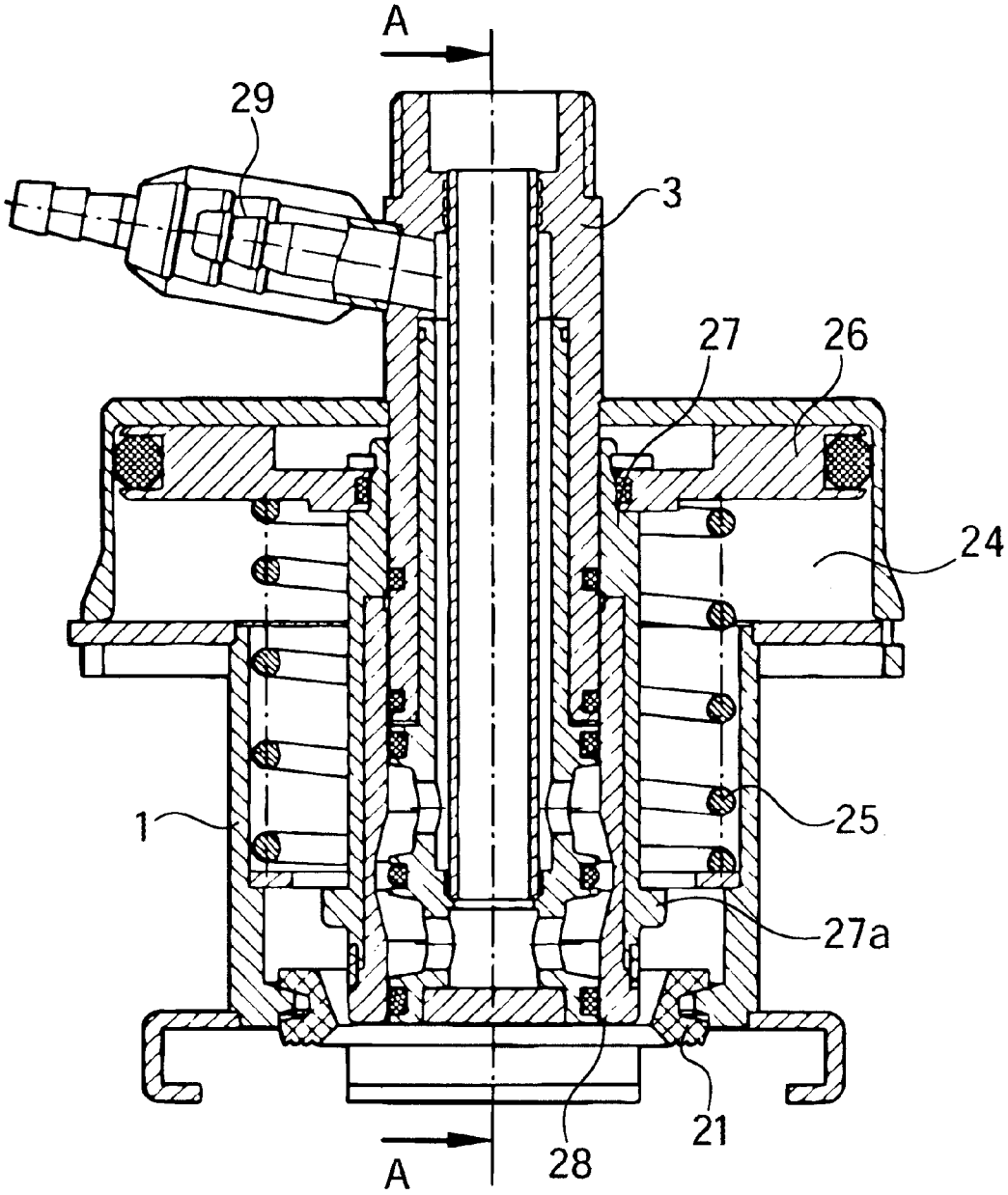
FIG. 6 shows a sectional view of an automatic tapping head according to the invention in the closing position.
Figure 7:
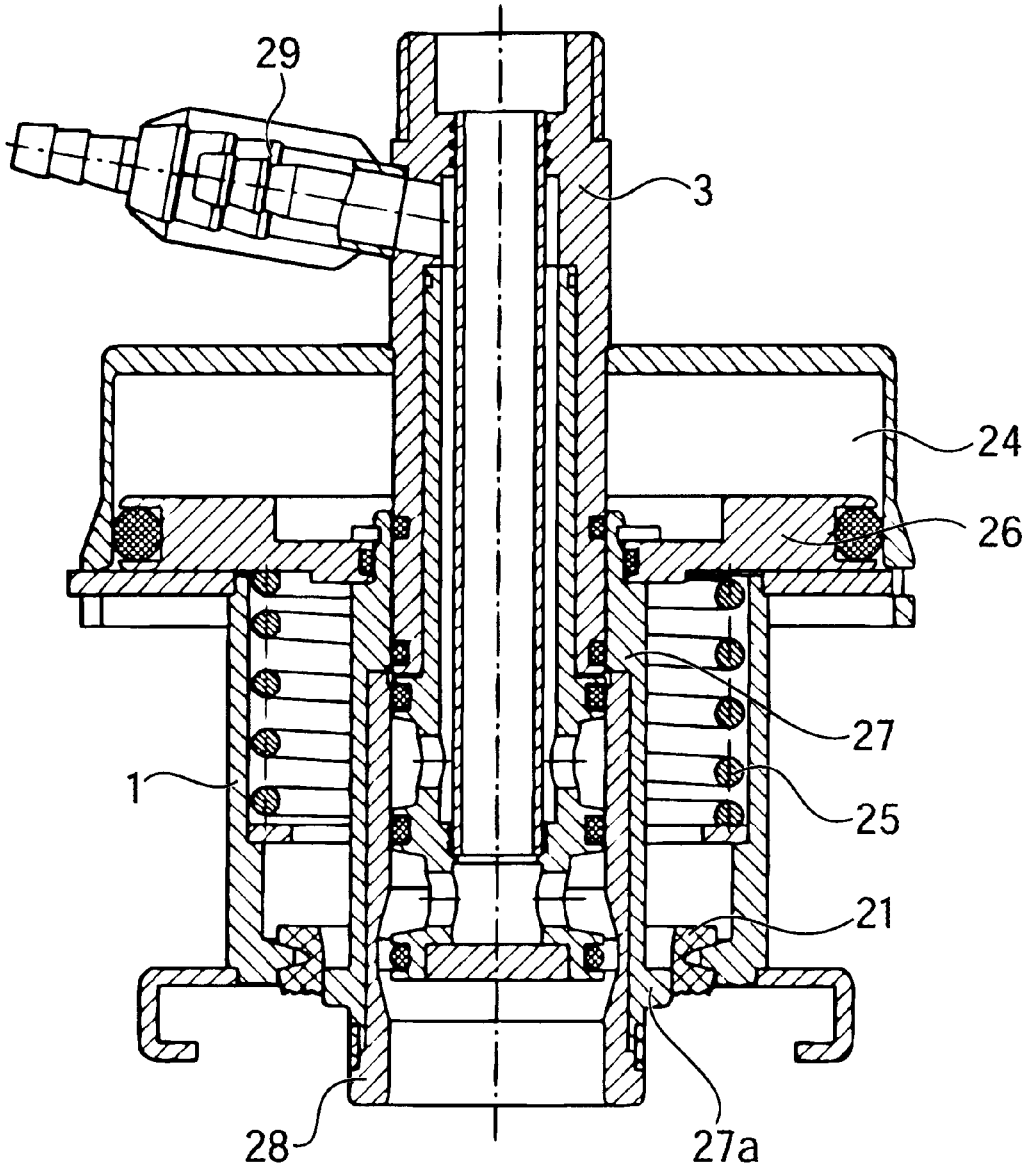
FIG. 7 shows the same arrangement of the tapping head in the pouring condition.

The shown tapping head may also be used with automatic tapping head systems as well in which the interior of the closing body forms the passage for the beverage line or the cleaning line. This embodiment is shown in FIGS. 6 to 8.

In this embodiment, a pneumatic system with a pressure chamber 24 and a coil spring 25 is provided instead of the lever. By admitting pressure to pressure chamber 24, a piston 26 is driven down and a slide 27 with a tappet 28 is driven down toward the barrel and driven into it. In the "up" condition (FIG. 7), the lower slide part 27*a* rests against sealing flange 21 and thus provides a seal between the housing and the slide.

Figure 8:
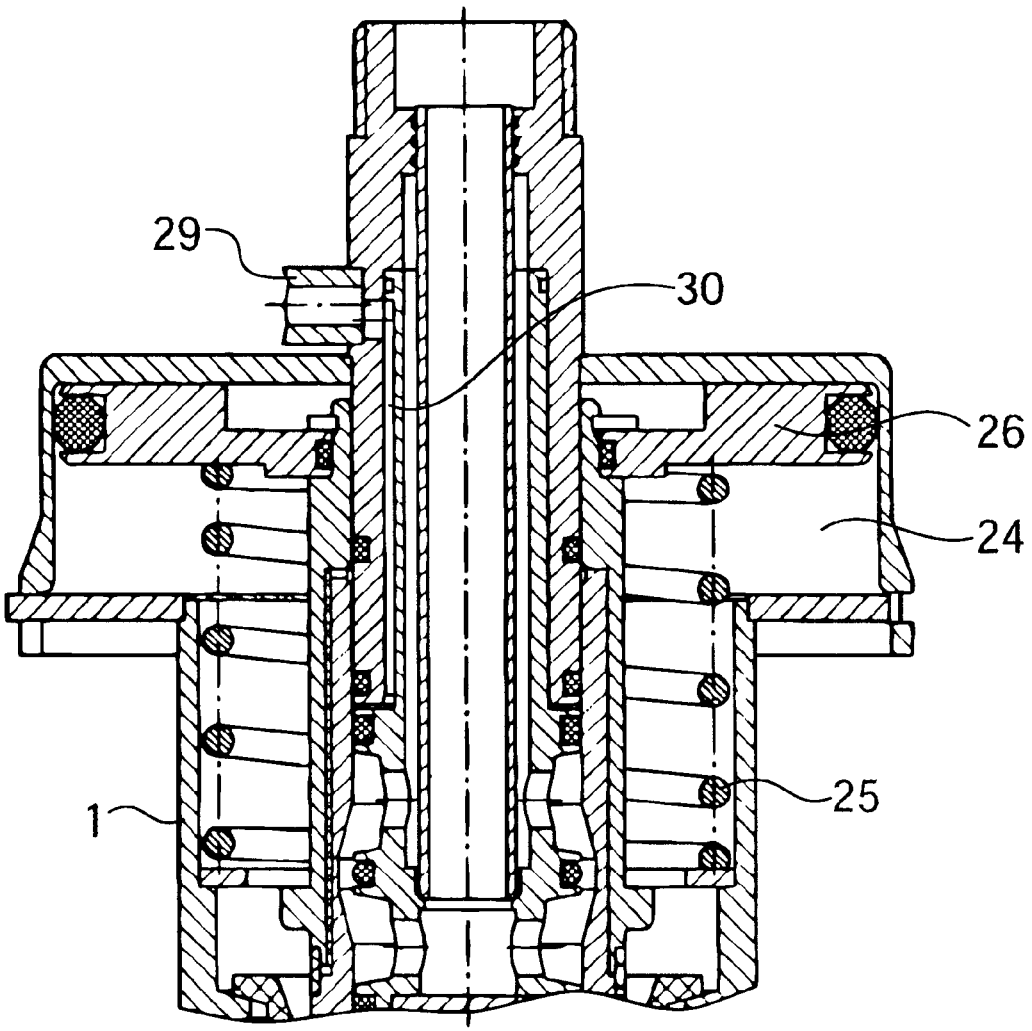
FIG. 8 shows a section along line A—A in FIG. 6.

The $CO_2$ feed 29 is connected with the gas channel shown in FIG. 8, the channel leading into the barrel via the tappet. In the closing condition (FIG. 6), the tappet is situated in the top position and the gas channel and the beverage feed are closed.

While several embodiments of the present invention have been shown and described, it is to be understood that many changes and modifications may be made thereunto without departing from the spirit and scope of the invention as defined in the appended claims.

What is claimed is:

1. A tapping head for tapping from a container beverages pressurized by gas having a pouring condition and a closing condition, which comprises:

(a) a housing having a beverage channel;

(b) a closing bolt arranged in said housing for opening and closing the beverage channel;

(c) a slide surrounding the closing bolt and movable up and down;

(d) a beverage connection connected to the beverage channel;

(e) a flange seal arranged in a lower part of the housing;

(f) a tappet arranged on an end of the slide having an O-ring for sealing the tappet against the closing bolt;

(g) a $CO_2$ connection arranged on said slide for conveying gas; and (h) a fastening screw connecting the closing bolt to the housing;

wherein in the pouring condition, the slide rests against the flange seal, and in the closing condition, the O-ring seals the tappet against the closing bolt.

2. The tapping head according to claim 1 further comprising:

(a) a locking lever having an upper position and a lower position;

(b) a bent spring connecting the actuating lever with the locking lever;

(c) a first locking bore engaged by the locking lever in the upper position; and (d) a second locking bore engaged by the locking lever in the lower position.

3. The tapping head according to claim 1 further comprising a spring-loaded, pneumatic device for actuating the slide so that in the closing condition a lower end of the slide rests against the flange seal.

4. A tapping head for tapping from a container beverages pressurized by gas having a pouring condition and a closing condition, which comprises:

(a) a housing;

(b) a closing bolt arranged in said housing;

(c) a slide surrounding the closing bolt and movable up and down;

(d) a tappet arranged on an end of the slide having an O-ring for sealing the tappet against the closing bolt;

(e) a flexible sleeve having a bead arranged on the lower end of the slide; and (f) a $CO_2$ connection arranged on said slide for conveying gas;

wherein in the pouring condition, the bead is placed against the slide, and in the closing condition, the O-ring seals the tappet against the closing bolt.

5. A tapping head for tapping from a container beverages pressurized by gas having a pouring condition and a closing condition, which comprises:

(a) a housing;

(b) a flange seal arranged in a lower part of the housing;

(c) a closing bolt arranged in said housing;

(d) a slide surrounding the closing bolt and movable up and down;

(e) a tappet arranged on an end of the slide having an O-ring for sealing the tappet against the closing bolt;

(f) a $CO_2$ connection arranged on said slide for conveying gas;

(g) a $CO_2$-switch arranged on the $CO_2$ connection;

(h) a check valve having a connecting and actuating bolt actuated by the switch; and (i) a conveying channel for the $CO_2$-gas in the slide connected to the check valve, wherein in the pouring condition, the slide rests against the flange seal and the check valve opens the conveying channel, and in the closing condition, the O-ring seals the tappet against the closing bolt and the conveying channel is connected to the atmosphere with the check valve closed.

6. The tapping head according to claim 5 wherein (a) the tapping head further comprises an actuating lever for moving the slide, the actuating lever moving up and down from a top pouring position to a bottom closing position, said actuating lever in the top pouring position keeping the check valve closed and in the bottom closing position opening the check valve; and (b) the $CO_2$-switch comprises a grooved guide engaging the housing with a switch guide when the actuating lever moves up and down.

* * * * *